United States Patent [19]

Brush, Sr. et al.

[11] Patent Number: 4,519,661

[45] Date of Patent: May 28, 1985

[54] CONNECTOR ASSEMBLY HAVING AN ANTI-DECOUPLING MECHANISM

[75] Inventors: Robert W. Brush, Sr., Unadilla; Eric F. Shepler, Bainbridge, both of N.Y.

[73] Assignee: Allied Corporation, Morristown, N.J.

[21] Appl. No.: 560,036

[22] Filed: Dec. 9, 1983

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 M, DIG. 2; 285/82, 89

[56] References Cited

U.S. PATENT DOCUMENTS

| | | | |
|---|---|---|---|
| 3,601,764 | 8/1971 | Cameron | 339/89 M |
| 4,109,990 | 8/1978 | Waldron et al. | 339/89 M |
| 4,165,910 | 8/1979 | Anderson | 339/89 M |
| 4,183,605 | 1/1980 | Arneson | 339/89 M |
| 4,239,314 | 12/1980 | Anderson et al. | 339/89 M |
| 4,268,103 | 5/1981 | Schildkraut et al. | 339/89 M |
| 4,272,144 | 6/1981 | Brush et al. | 339/89 M |
| 4,277,125 | 7/1981 | Ball | 339/113 R |
| 4,468,077 | 8/1984 | Brush, Sr. et al. | 339/89 M |
| 4,472,013 | 9/1984 | Frear | 339/89 R |

*Primary Examiner*—John McQuade

*Attorney, Agent, or Firm*—C. D. Lacina; R. J. Eifler

[57] ABSTRACT

The invention is an anti-decoupling mechanism for a connector assembly characterized by an axially extending portion (42) at the free end of a spring (40) which engages an axially extending shoulder (12) at the start of a thread (11) on one of the housings (10) during a portion of the final coupling rotation of the coupling ring (30) around the first housing (10). During the final portion of coupling rotation of the coupling ring (30) the projection (41) is moved inwardly to increase the pressure between the projection (41) and the teeth (21) thereby resisting decoupling of the housings (10, 20) when the coupled connector assembly is subjected to vibration.

4 Claims, 4 Drawing Figures

CONNECTOR ASSEMBLY HAVING AN ANTI-DECOUPLING MECHANISM

This invention relates to a connector assembly of the type having a coupling ring for coupling and decoupling the two housings of the connector assembly. The invention is more particularly related to an improved anti-decoupling mechanism that retains the coupled housings together against forces, such as vibration, which tend to uncouple the housings.

A connector assembly is used to connect together separate lines that convey a signal; such as wires in electrical circuitry and optical fibers in light transmitting circuitry. The assembly includes two housings that may be coupled together by a coupling ring rotatably mounted on one of the housings. The other housing and the coupling ring each have threads which when mated together, and the coupling ring rotated, draws the housings together and mates respective electrical contacts mounted within the housings. To prevent decoupling of connector housings, some connector assemblies include anti-decoupling mechanisms that are comprised of one or more springs having a projection thereon mounted on the inside of the coupling ring and a plurality of teeth annularly arranged and projecting from one of the housings that engage the projections. One example of an electrical connector assembly having this type of anti-decoupling mechanism may be found in U.S. Pat. No. 4,109,990 issued Aug. 29, 1978 and entitled "Electrical Connector Assembly Having Anti-Decoupling Mechanism". In this arrangement the projections on the springs are continuously pressed against the teeth during the coupling and decoupling of the connector housings. This results in excessive wear of the projections and the teeth after the housings have been coupled and decoupled 500 times or more to comply with durability requirements. As the ratchet teeth and projection on the spring wear, the anti-decoupling mechanism becomes less effective. This increases the likelihood that the coupling ring will rotate and cause partial or complete decoupling of the housings. In an electrical connector this causes partial of complete unmating of the electrical contacts within the respective connector housings, which results in the loss of diminution of the electrical signal conveyed by the contacts.

DISCLOSURE OF THE INVENTION

This invention reduces the wear between the engaging members of an anti-decoupling mechanism for a connector assembly of the type utilizing a spring and ratchet teeth arrangement between a coupling ring and a connector housing. The invention is characterized by an axially extending portion at the free end of each of the springs that is adapted to engage a respective shoulder on the other housing and apply additional pressure between the spring and teeth during the last few degrees of rotation during coupling of the housings.

One advantage of this invention is that it improves the durability of the anti-decoupling mechanism of a connector assembly.

Another advantage of this invention is that it increases the effectiveness of the anti-decoupling mechanism over previous mechanisms.

Another advantage of the invention is that it provides for an increase of pressure between the engaging members of the anti-decoupling mechanism during the last portion of the final coupling rotation of the coupling ring.

DETAILED DESCRIPTION OF THE INVENTION

Figures 1, 2, 3, 4:
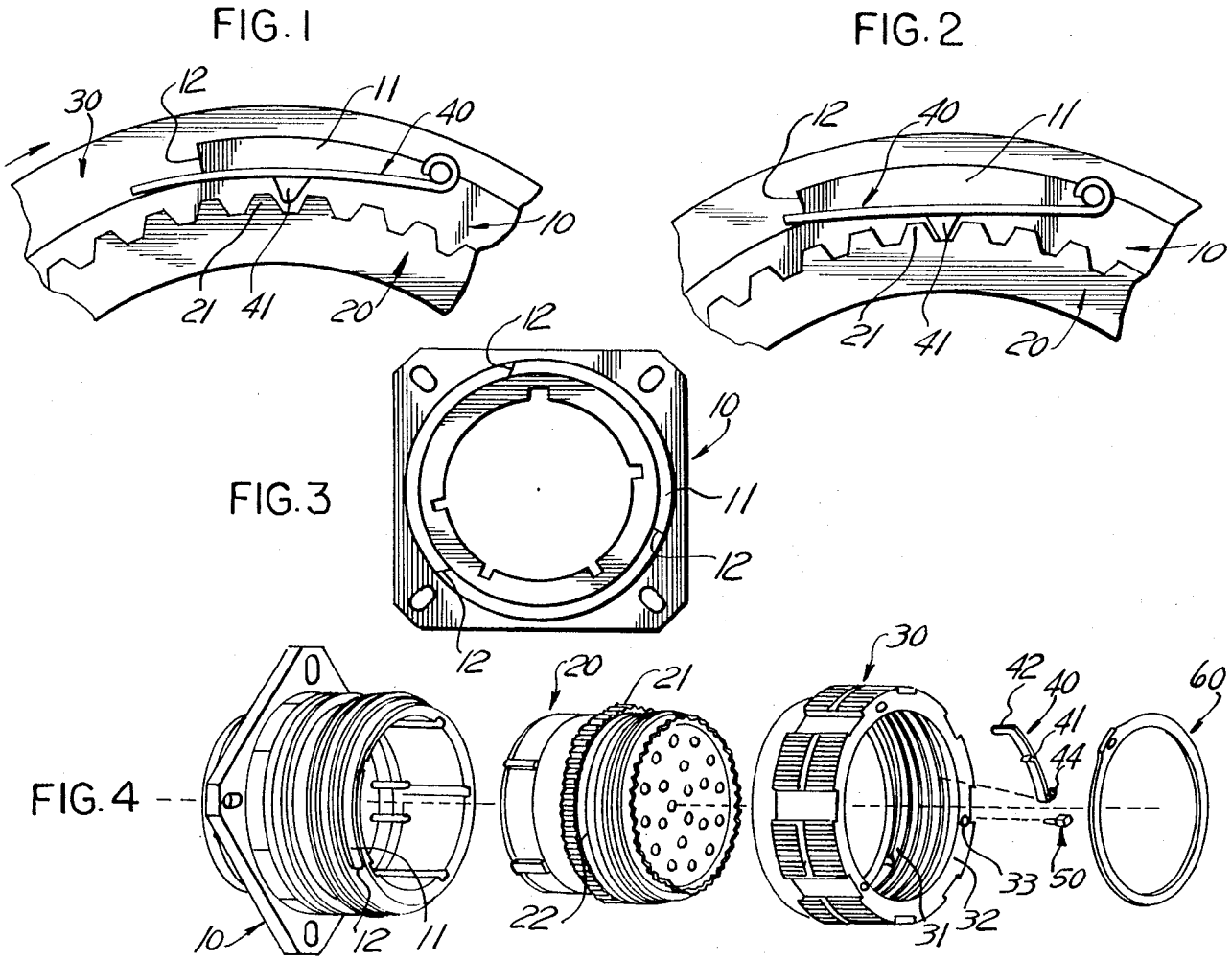
FIGS. 1 and 2 illustrate a partial diagrammatic view of the anti-decoupling mechanism of an electrical connector assembly.
FIG. 3 is an end view of the receptacle for an electrical connector assembly shown in FIG. 4.
FIG. 4 illustrates an exploded view of a connector assembly incorporating the features of this invention.

Referring now to the drawings, FIG. 1 is a partial view of a connector assembly which illustrates the anti-decoupling mechanism incorporating the principles of this invention. This Figure illustrates the coupling ring 30, which is rotatably mounted on one of the housings 20, just before it is completely coupled to the other housing 10. A spring 40 is mounted at one end to the inside of a coupling ring 30 which couples together two housings 10, 20. One of the housings 10 includes a thread 11 on the forward portion thereof that starts with an axially extending shoulder 12. The other housing 20 includes a plurality of radially extending and annularly arranged teeth 21 that engage an inwardly extending radial projection 41 on the spring 40.

FIG. 2 illustrates a partial view of a connector assembly with the coupling ring 30 completely coupled to the housing 10. During the last portion of the rotation of coupling the coupling ring 30 to the housing 10, the axially extending end portion 42 of the spring 40 engages the blunt start shoulder 12 of the thread 11 and upon further rotation of the coupling ring 30 in the same direction causes the projection 41 to be pressed further between the teeth 21 on the other housing 20 hence, increasing the pressure between the projection 41 and the teeth 21.

FIG. 3 is an end view of a receptacle for the electrical connector assembly shown in FIG. 4. This view illustrates that there are preferably three threads 11 on the receptacle housing 10 and that each of the threads has a blunt start, i.e., an axially tapered shoulder 12 rather than a tapered portion.

FIG. 4 illustrates an exploded view of a connector assembly incorporating the features of this invention. The connector assembly is generally comprised of a first housing 10, a second housing 20, and a coupling ring 30. Not shown are electrical contacts or optical fiber terminals that may be mounted within the housings 10, 20. The coupling ring 30 is rotatably mounted to the housing 20 by captivating its radial flange portion 32 against the annular shoulder 22 of the housing 20 by a snap ring 60. Mounted inside the coupling ring 30 there are preferably three springs 40. Each of the springs 40 has a radial projection 41 and an axially extending portion 42 which is adapted to engage a blunt start or axial shoulder 12 of the thread 11 on the housing 10. Each of the springs 40 is mounted inside the coupling ring 30 by a pin 50 that extends through a hole 33 in the flange 32 of the coupling ring 30 and through the coiled end portion 44 of the spring 40. Inside the coupling ring 30 there are three threads 31 which match the number of threads 11 on the housing 10.

To couple the connector assembly together the coupling ring threads 31 are engaged with the threads 11 on the housing 10 and the coupling ring 30 is rotated. This draws the second housing 20 into the first housing 10 to mate any electrical contacts or fiber optic terminals mounted within the housings 10, 20. During the last five degrees of rotation of the coupling ring 30 onto the housing 10 the axially extending portion 42 of the free end of the spring 40 engages the shoulder 12 on the threads 11 and moves the projection 41 on the spring 40 inwardly. This causes a greater pressure between the projection 41 on the spring 40 and the teeth 21 on the housing 20. This increased pressure between the projection 41 and the teeth 21 helps to prevent decoupling of the housings 10, 20 when the coupled connector assembly is subjected to vibration.

While a preferred embodiment of the invention has been disclosed, it will be apparent to those skilled in the art that minor changes may be made to the invention as set forth in the appended claims and, in some instances certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. In combination with a connector assembly of the type having: a first tubular housing having around an outside portion thereof at least one thread, each thread having at its starting end an axially extending shoulder; a second tubular housing; a coupling ring having around the inside portion thereof at least one thread mated with a respective thread on said first housing; means for rotatably mounting said coupling ring to said second housing; and means for retarding rotation of said coupling ring including: a plurality of teeth annularly arranged on said second housing; at least one elongated spring having a projection thereon; and means for mounting each of said springs at one end to an inside portion of said coupling ring so that the projection on each of said springs engages said teeth on said second housing, the improvement wherein the means for retarding rotation of said coupling ring further includes:

an axially extending portion at the free end of each of said springs adapted to engage a respective axially extending shoulder at the start of a thread on said first tubular housing and move said projection inwardly to increase the pressure between said projection and teeth during the final portion of coupling rotation of the coupling ring around said first tubular housing.

2. The connector assembly described in claim 1 wherein the axially extending portion of the spring engages the starting shoulder of a thread in the first housing during the last five degrees of rotation of coupling the coupling ring onto the first housing.

3. A connector of the type having: a tubular housing; a coupling ring rotatably disposed on said tubular housing and having interior thread for threadably engaging with exterior thread on a compatible connector housing whereby to advance the housings axially towards one another for mating, said exterior thread having its thread start provided with a radial face; means for mounting said coupling ring to said tubular housing; and means for retarding rotation of said coupling ring including: a plurality of teeth annularly arranged on said tubular housing; an elongated, generally straight, spring having a radial medial projection thereon; and means for mounting one end of said spring to an inside portion of said coupling ring so that the medial projection engages said teeth on said tubular housing, the improvement wherein the means for retarding rotation of said coupling ring further includes: an axially extending portion at the free end of said spring with said axially extending portion being adapted to engage the radial face of said exterior thread upon a predetermined rotation of the coupling ring thereto, said spring being disposed substantially in a plane which is perpendicular to the axis of rotation of the coupling ring.

4. An electrical connector assembly of the type having: a first tubular housing having mounted therein at least one electrical contact and having around an outside portion thereof at least one thread, each thread having at its starting end an axially extending shoulder; a second tubular housing having mounted therein at least one electrical contact adopted to mate with a respective contact mounted in said first housing; a coupling ring having around an inside portion thereof at least one thread mated with a respective thread on said first housing; means for rotatably mounting said coupling ring to said second housing; and means for retarding rotation of said coupling ring including: a plurality of teeth annularly arranged on said second housing; at least one elongated spring having a projection thereon; and means for mounting each of said springs at one end to an inside portion of said coupling ring so that the projection on each of said springs engages said teeth on said second housing, wherein the means for retarding rotation of said coupling ring is characterized by:

an axially extending portion at the free end of each of said springs adapted to engage a respective axially extending shoulder at the start of a thread on said first tubular housing and move said projection inwardly to increase the pressure between said projection and teeth during the final portion of coupling rotation of said coupling ring around said first tubular housing.

* * * * *